US005080353A

United States Patent [19]

Tench

[11] Patent Number: 5,080,353

[45] Date of Patent: Jan. 14, 1992

[54] AEROBIC EXERCISE CHAIR

[76] Inventor: Lee Tench, 4401 Roswell Rd., Atlanta, Ga. 30350

[21] Appl. No.: 610,691

[22] Filed: Nov. 8, 1990

[51] Int. Cl.[5] ..... A63B 21/04

[52] U.S. Cl. ..... 272/144; 272/136; 272/117

[58] Field of Search ..... 272/138, 143, 144, 134, 272/130, 120, 121, 142, 136, 126, 123

[56] References Cited

U.S. PATENT DOCUMENTS

| | | | |
|---|---|---|---|
| 3,738,649 | 6/1973 | Miller | 272/134 |
| 4,603,855 | 8/1986 | Seballe | 272/117 |
| 4,720,099 | 1/1988 | Carlson | 272/144 |
| 4,815,732 | 3/1989 | Mahvi | 272/144 |
| 4,817,943 | 3/1989 | Pipasik | 272/134 |
| 4,921,247 | 5/1990 | Sterling | 272/136 |

*Primary Examiner*—Richard J. Apley
*Assistant Examiner*—Jerome Donnelly
*Attorney, Agent, or Firm*—Jones, Askew & Lunsford

[57] ABSTRACT

An exercise machine providing a variety of different exercises, useful for both aerobic and strength building purposes, while a person remains seated. The apparatus includes a chair mounted within a frame assembly which supports and also forms part of the various exercise elements. The exercise elements are operated by the feet and by the hands or arms of a person seated in the chair.

6 Claims, 2 Drawing Sheets

AEROBIC EXERCISE CHAIR

FIELD OF INVENTION

This invention relates in general to exercise apparatus, and relates in particular to aerobic exercise apparatus embodied in a chair.

BACKGROUND OF THE INVENTION

Persons of all ages are becoming more aware of the physical and mental benefits derived from personal fitness. These benefits include improved muscule tone and strength making a person better able to undertake normal physical activities without becoming fatigued, and improved cardiovascular stamina arising from aerobic exercise. In addition to the purely physical improvements in strength, stamina, and longevity expected from appropriate exercises, many people perceive the further advantage of feeling better about themselves as their improved physical fitness makes them more able to cope with the activities of living.

Different kinds of exercises are considered necessary for producing different results. For example, improved muscule strength and tone are obtained by working the appropriate muscles against a resisting force. Lifting free weights and working on various known kinds of exercise machines are two examples of exercises intended to build or maintain body strength. Aerobic exercise is considered essential to improve cardiovascular fitness and stamina; running, jogging, and aerobic workout routines are examples of such exercises. Aerobic exercise machines including treadmills, stationary bicycles, and stair step climbers are examples of exercise machines intended primarily to provide the benefits of aerobic exercise to the user.

Although many different kinds of exercise and workout machines are known, these machines generally are purpose-specific. Aerobic exercisers generally are not intended to provide strength-building exercises, and the exercises available through weight machines may not provide significant amounts of aerobic workout. Moreover, the costs of these individual machines are such that purchasing several machines for both strength and aerobic exercises is beyond the reach of most users. Further yet, few homes or offices have adequate room for placing several different exercise machines.

Furthermore, present exercise machines are designed for use by individuals of normal health and physical capabilities, making these machines less than suitable for the elderly, the handicapped, those recovering from debilitating illness or surgery, and others unable to use such existing machines. For example, a treadmill is of little benefit and may actually prove dangerous for patients unable to stand or walk without assistance, although those patients may need routine exercises to rebuild or maintain their physical stamina and general well-being. Similarly, the complexity and overall appearance of conventional strength-building exercise machines may inhibit their use by many who lack normal physical capabilities but need the benefit of exercises keyed to their present capability.

SUMMARY OF INVENTION

Stated in general terms, the present invention enables a person to remain seated while undergoing a variety of different exercises which work various muscles and which also have an aerobic component to improve the cardiovascular capabilities of the user. Each exercise with the present apparatus is performed while the person remains seated, and without requiring adjustment or modification of the apparatus between different exercises.

Stated somewhat more particularly, the present exercise chair makes available a variety of separate exercise routines for a person seated in the chair. These exercise routines include arm pushes along a generally horizontal plane, vertical arm push ups, arm pull downs, and arm wrap arounds with the forearms held generally upright with the elbows bent. The legs and feet can be exercised with a foot shuffle exerciser, or with a bicycle exerciser. Strength in the arms and torso is built with a rowing exerciser extending from the front of the exercise chair. These various exercise devices are integrated into the chair frame, which preferably is of tubular construction for that purpose. Various of the exercise elements operate against an elastic or resilient force which is adjustable to suit the requirements of the individual user.

Accordingly, it is an object of the present invention to provide an improved exercising apparatus.

It is another object of the present invention to provide an exercise machine in the form of a chair which allows the person to exercise various parts of the body while remaining seated in the chair.

It is a further object of the present invention to provide an exercise chair integrally provided with a number of exercise elements permitting aerobic and strength exercises for a person remaining seated in the chair.

The foregoing and other objects and advantages of the present invention will become more readily apparent from the following description of a preferred embodiment.

DETAILED DESCRIPTION OF PREFERRED EMBODIMENT

Figure 1:
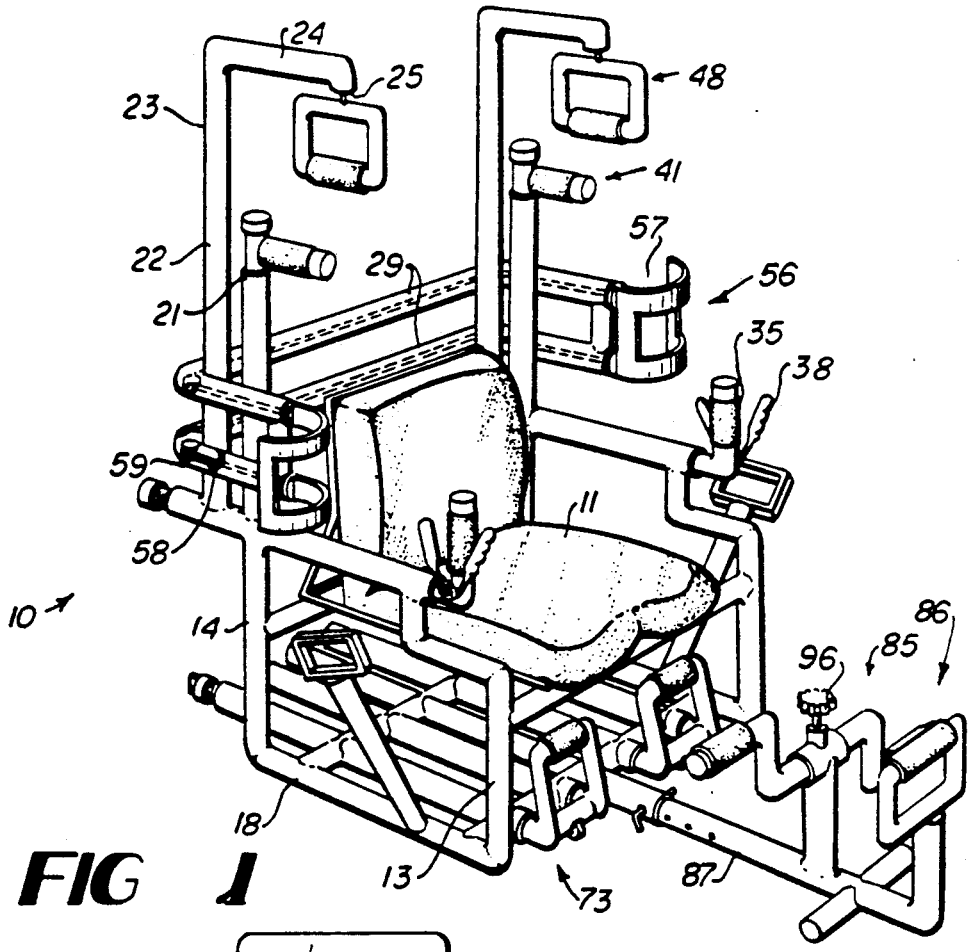
FIG. 1 is a pictorial view showing an exercise chair according to a preferred embodiment of the invention.
Figure 2:
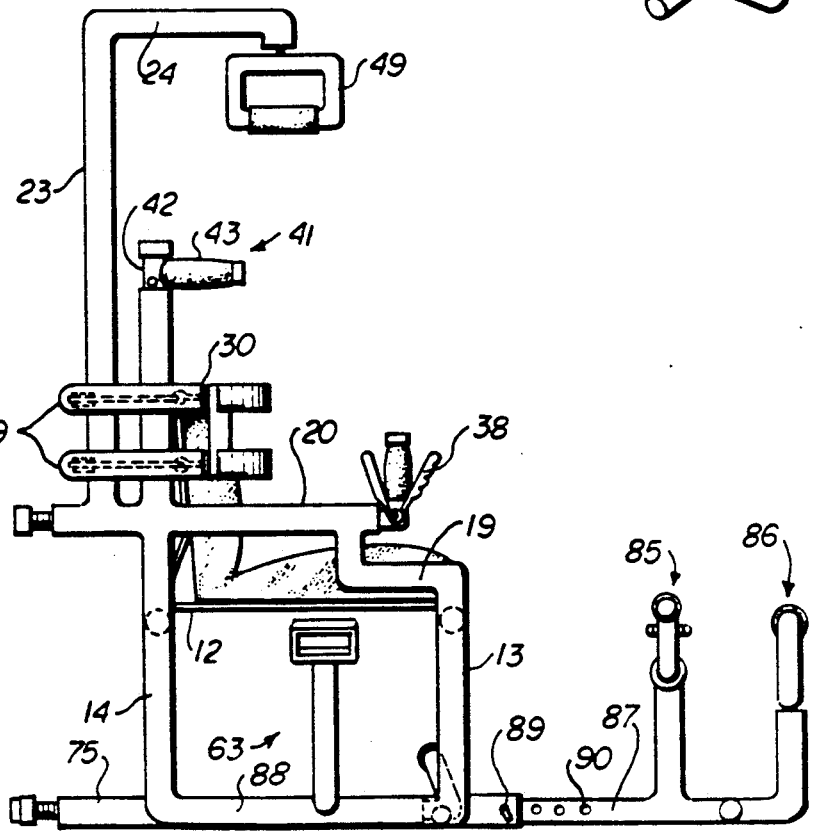
FIG. 2 is a side view of the exercise chair shown in FIG. 1.

Turning first to FIG. 1, there is shown generally at 10 an exercise chair according to a preferred embodiment of the present invention. This exercise chair has a seat 11 including a bottom member and a back member, both of which preferably are cushioned for the comfort of a person occupying the seat. Horizontal support members 12, one of which is best shown in FIG. 2, extend between the front and rear vertical supports 13 and 14 on each side of the chair 10 and hold the seat 11 in place. These support members 12 preferably are inelastic, so that the seat 11 cannot bounce or otherwise move with regard to the surrounding frame assembly while a seated person makes use of the various exercise elements as described below.

The vertical supports 13 and 14 form part of the frame assembly which supports and partially surrounds the seat 11, and which also supports the exercise elements of the exercise chair. This frame assembly in the preferred embodiment is fabricated of hollow tubular elements for ease and economy of construction, and also to contain the various exercise elements and the resilient devices associated with those elements. Tubular members of plastic, such as PVC or the like, provide a relatively lightweight construction wherein one person can move the exercise chair from place to place. However, other constructions will suggest themselves to those skilled in the art.

Connecting the bottoms of the vertical elements 13 and 14 on each side of the chair 10 is a horizontal floor support 18. The upper end of each forward vertical support 13 ends somewhat below the upper surface of the seat 11, as best seen in FIG. 2, and jogs rearwardly as at 19 to join the arm rest 20 on each side of the seat. The rear vertical support 14 joins the arm rest 20 behind the back of the seat 11, and extends upwardly from the arm rest to an upper end 21 elevated above the back cushion of the seat 11. Each arm rest 20 extends rearwardly to terminate a distance behind the rear vertical support 14. Joining this rearward extension of each arm rest 20 is the longer leg 22 of an inverted L-shaped member 23, having a short horizontal section 24 extending forwardly and adjoining a downwardly-facing open end 25 located a distance above and in front of the upper end 21 of the rear vertical support 14. It will be appreciated that the upper end 21 of the rear vertical support 14 and the downwardly-facing open end 25 of the L-shaped member 23 each generally occupy the same vertical planar as the arm rest 20, in the disclosed embodiment.

A pair of vertically-spaced tubular horizontal members 29 extend across and are secured to the legs 22 of the L-shaped members 23. Each of the horizontal members 29 has a right-angle bend extending around the legs 22 and the rear vertical support 14 at a distance above the arm rest 20, so that the horizontal members 29 terminate at open ends 30 located a short distance in front of the rear vertical support and somewhat above the arm rest.

Figure 4:
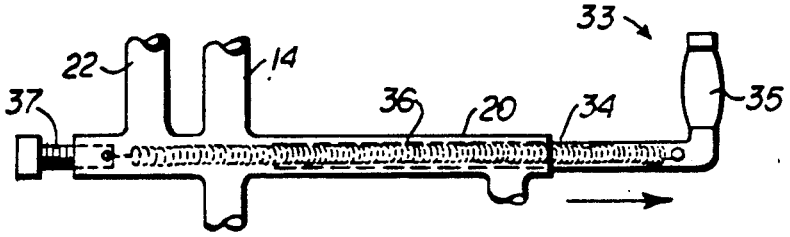
FIG. 4 is an enlarged fragmentary side view showing one of the arm push exercise elements partially extended.

Details of various exercise elements now are described with reference made to members of the frame assembly as disclosed thus far. The first such exercise element are the arm pushes 33, one of which is best seen in FIG. 4 and includes a tubular member 34 telescopically received within the arm rest 20. A hand grip 35 extends outwardly at a right angle to the tubular member 34 of each arm push, and the hand grips preferably are padded with a suitable cushioning material for ease of grasping by the hands of a person occupying the seat 11. A resilient member such as the tension coil spring 36 is contained within each arm rest 20, engaging the tubular member 34 and urging that member rearwardly into a fully-retracted position within the arm rest. The back end of the coil spring 36 is attached to a tension adjusting mechanism 37 accessible at the back end of the arm rest 20, allowing adjustment of the rearward force exerted on the arm push 33 by varying the tension of the spring 36.

A person occupying the seat 11 can operate each arm push 33 by grasping and pushing forwardly the handles 35 against the restoring force of the springs 36. This back-and-forth motion may be exerted simultaneously on each arm push, or may alternate with one arm moving forward while the other arm moves backward, and vice versa.

Each hand grip 35 can optionally be fitted with a wrist grip exerciser 38 (FIG. 1) for exercising hand muscles by alternately gripping and releasing the wrist grip while working on the arm pushes 33. The hollow concentric construction of each tubular member 34 within the tubular arm rest 20 permits rotating the inner tubular member 34 180° so that the hand grips 35 are directed substantially downwardly when the arm push exercisers 33 are not in use.

Figure 6:
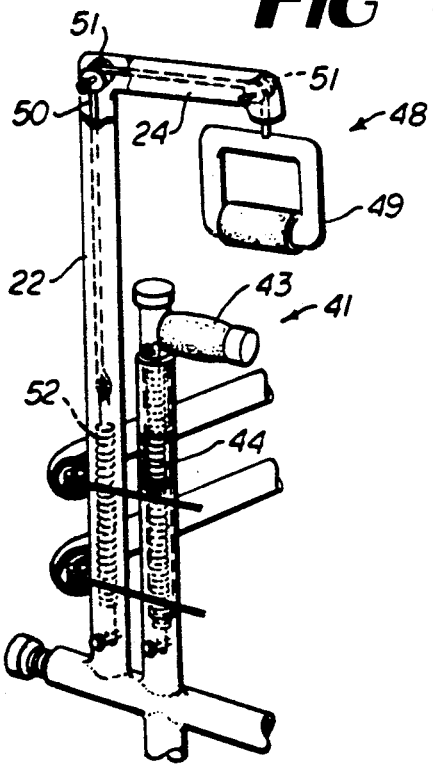
FIG. 6 is an enlarged fragmentary pictorial view showing details of the arm pull-down and arm push-up exercise elements in the present exercise chair.

Described next are the arm push-up exercisers 41 as best seen in FIG. 6. Each arm push-up 41 comprises a vertical tubular member 42 telescopically received within the upper end 21 of the rear vertical support 14. Extending outwardly from the upper end of each tubular member 42, at a right angle thereto, is a hand grip 43 which is preferably padded as previously described. A resiliently extensible device such as the tension coil spring 44 is received within the hollow inner tubular member 42, and extends downwardly from that member to an anchor point in the rear vertical support 14, such that the coil spring exerts a retractive force urging the inner tubular member 42 downwardly to the fully-retracted position shown in the figures.

To exercise using the arm push-ups 41, a person occupying the seat 11 raises his or her arms to grasp the forwardly-extending hand grips 43. The person then alternately raises and lowers the hand grips, causing extension of each inner tubular member 42 against the restoring force of the tension spring 44. These upward and downward movements of the hand grips 43 can be either concurrent or sequential, depending on the desires of the exerciser.

Turning next to the arm pull-down exercisers 48 whose details are best seen in FIG. 6, each such exerciser includes a D-shaped hand grip 49 suspended immediately below the downwardly-facing open end 25 at the upper end of the inverted L-shaped member 23. The hand grip 49 is attached to one end of a cable 50 disposed within the hollow L-shaped member 23, and the lower end of the hand grip preferably is padded for ease of gripping by the hand of a person occupying the seat 11. The cable 50 passes over pulleys 51 at both ends of the short horizontal section 24, and extends downwardly within the longer leg 22 of the L-shaped member 23 to engage a tension coil spring 52 mounted near the lower end of the longer leg. The normal retracted condition of the spring 52 maintains the hand grips 49 in their elevated position as shown in the figures.

In using the arm pull downs 48, a person occupying the seat 11 reaches upwardly with both hands and graps the hand grips 49. The person then can pull downwardly on each hand grip, extending the cable 50 against the restoring force of the spring 52. These downward pulls can be concurrent or alternate, and need not be limited to purely vertical movement. Thus, the person can move his or her arms inwardly or outwardly while raising and lowering the hand grips, to vary the effect of that movement on the muscles used while pulling and retracting the hand grips.

The shoulder exercisers 56 as shown in FIGS. 1 and 2 are next described. These shoulder exercisers each comprise a generally C-shaped forearm engagement member 57 normally held in place flanking the seat 11, at the outer ends 30 of the two horizontal members 29. Each forearm engagement member 57 is connected to the ends of a pair of elastic cords 58, one passing through each hollow horizontal member 29 and connected to the corresponding part of the opposite forearm engagement member. Pulleys 59 at each corner of the horizontal members 29 allow the elastic cords 58 freedom of movement within the horizontal members.

To use the shoulder exercise apparatus 56, a person in the seat 11 places his or her upright forearms within the rearwardly-facing open portion of each forearm engagement member 57. The person then moves the forearms forwardly and backwardly, either simultaneously or alternately, movement which comes from the shoulders and back and which exercises the corresponding groups of muscles within those portions of the body. Because the forearm engagement members 57 are interconnected by elastic cords in the disclosed embodiment, the amount of force required for forward movement of each engagement member becomes greater as that forward movement increases. Moreover, the flexibility of the elastic cords 58 allows the exerciser to vary the forward movement; this movement thus may be more or less straightforward and back, or may be a more arcuate movement caused by alternately bringing the forearms toward and away from each other in front of the body.

Figure 5:
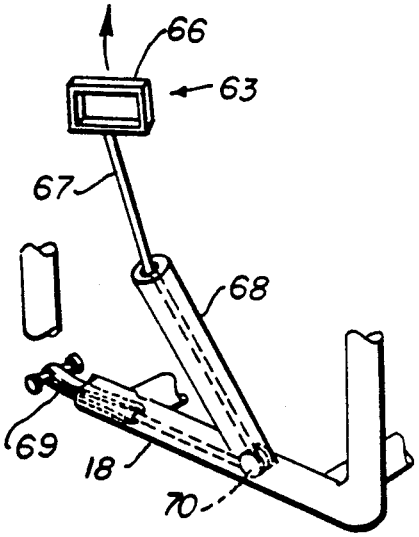
FIG. 5 is an enlarged fragmentary view, shown partially broken away for illustrative purposes, showing one of the arm pull-up exercisers partially extended.

One of the arm pull-up exercisers 63 is best seen in FIG. 5, and includes a handgrip 66 attached to a flexible cord 67 normally fully retracted within the hollow tube 68 extending upwardly and diagonally outwardly from the floor support 18. The cord 67 urges the handgrip 66 downwardly toward the top end of the tube 68, and this downward force is provided by the elastic member 69 secured within the floor support 18 and attached to the remote end of the cord. The cord 67 passes around a pulley 70 where the tube 68 joins the floor support 18.

In use, the handgrip 66 of each arm pull up exerciser 63 is grasped by a person occupying the seat 11. These handgrips then are pulled upwardly, either simultaneously or alternately, either with the elbows kept straight and the entire arm describing a somewhat fanning movement or with the elbows bent where each arm performs a lifting movement while extending and retracting the handgrip 64.

The exercise chair 10 also includes a pair of shuffle exercisers 73 for engagement by the feet of a person occupying the chair. Each shuffle exerciser 73 includes a pair of inner tubular members 74 telescopically received within a mating pair of hollow outer tubular members 75. The outer tubular members 75 are located at the same horizontal level as the floor supports 18 of the frame assembly and provide added support for the exercise chair 10 on the floor. Joining together the forward ends of the two inner members 74 making up each shuffle exerciser 73 is a foot grip comprising a short upright member 76 extending upwardly from each inner member and joined at upper ends by the horizontal foot engaging member 77. The foot engaging member 77 preferably is suitably padded. A lower horizontal member 78 spans the immediate outer ends of the telescopic inner members 74 and preferably carries a downwardly-facing roller 79. This roller is positioned relative to the underside of the floor supports 18 to maintain the roller out of contact with the floor while the exercise chair 10 is in use, but the rollers allow easy positioning of adjustment of the chair by anyone standing behind the chair and tipping it forwardly to place the rollers into engagement with the floor, after which one can roll the chair wheelbarrow-fashion to a different location.

The inner tubular members 74 normally are maintained in the fully-retracted position, shown in FIG. 1, by means of a tension spring 80 or other suitable elastic member, contained within the inner members and the outer tubular members 75. The remote end of the tension spring 80 is connected to a tension adjustment mechanism 81 at the back end of the outer member 75 containing the spring.

In use, a person occupying the seat 11 can engage the foot member 77 of each shuffle exerciser, and then move the shuffle exercisers forwardly and rearwardly in shuffle fashion. That person either can place the feet directly on the upper foot-engaging member 77, or alternatively can place his or her toes beneath that member and into the space defined between the upright members 66 and the lower horizontal member 78. This latter placement of the feet keeps the feet substantially horizontal as shuffle exercising takes place, thereby burying the exercise imparted to the foot and ankle.

Two more exercise elements, the bicycle exercise 85 and the hand pull or rowing exerciser 86, are supported on the hollow tubular member 87 telescopically received within the outer tubular member 88 located beneath the seat 11 generally parallel to and coplanar with the pairs of outer members 75 associated with the shuffle exercisers. The outer member 88 and corresponding inner member 87 are symmetrical along the front-back axis of the exercise chair 10. The telescopic position of the inner member 87 is adjustably fixed within the outer member 88 by means of a pin 89 extending through one of the spaced holes 90 in the inner member 87 and an aligned hole (not shown) extending through the outer member 88. This longitudinal adjustment of the inner member 87 permits changing the location of the bicycle exerciser 85 and the hand pull 86 relative to the seat 11, for persons of different arm reach and leg length.

Figure 3:
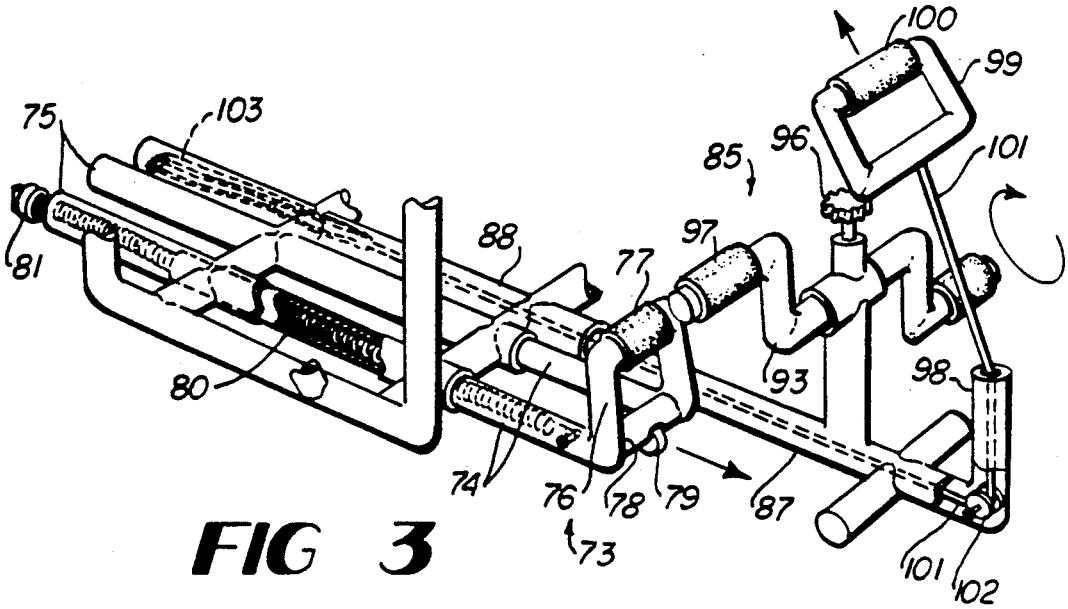
FIG. 3 is an enlarged fragmentary pictorial view, partially broken away for illustrative purposes, showing the foot shuffle and rowing exercise elements of the exercise chair in FIG. 1.

The bicycle exerciser 85, as best shown in FIG. 3, includes a crank mechanism 93 rotatably supported in a central bearing 94 supported above the inner tubular member 87 by an upright post 95 attached to that latter member. An adjustment knob 96 connects to a drag brake exerting variable resistance on the crank member 93 within the bearing 94, so as to adjust the amount of force needed to rotate the crank at a given speed. The outer ends of the crank member 93 are fitted with foot rests 97.

In use, a person sitting in the chair 11 places his or her feet on the foot rests 97 of the crank member 93, once the horizontal position of the inner tubular member 87 relative to the seat is adjusted to suit. The person then can exercise thigh and leg muscles by pedalling the crank mechanism, and can vary the extent of this exercise by increasing or reducing the pedalling resistance by means of the adjusting knob 96. It should be understood, moreover, that the pedalling exercise (or the shuffle exerciser 73) can be utilized while the exerciser simultaneously is using one of the hand-operated exercisers previously described.

Turning now to the hand pull 86, that exerciser comprises an D-shaped hand pull 99 having a padded handgrip 100 on the upper side, and connected at the lower side to a flexible cord 101 (FIG. 3). The cord 101 extends downwardly through the short upright hollow tube 98 joined to the forward end of the tubular inner member 87, and passes around the pulley 102 at the juncture of those two tubes. The cord 101 then extends rearwardly through the concentric tubes 87 and 88 for attachment to the elastic member 83 anchored at the back of the outer tube 88. This elastic member, as with the other elastic members described in the disclosed embodiment, may be either an elastomeric resilient band or a tension coil spring, or their functional equivalent, which urges the handgrip 99 to the fully-retracted position shown in FIGS. 1 and 2.

To use the hand pull exerciser 86 while occupying the seat 11, the person bends forwardly to grasp the hand pull 99 with either or both hands. The person then alternately pulls and retracts the hand pull 99, using a rowing motion, alternately bending back and forth at the waist while flexing the arms at the elbows.

From the foregoing description of the disclosed embodiment, it can now be seen that the present exercise chair enables the user to undergo both strength-building exercises and aerobic exercises while remaining seated in the chair. Furthermore, a person can exercise both the arms and the legs at the same time, and can select any available exercise without leaving the chair to adjust or to select any particular exercise element. The resilient restoring forces are supplied to the various exercise elements by means of inexpensive and dependable springs or elastic cords, although those skilled in the art will realize that other force-resisting elements such as hydraulic or pneumatic pistons may be utilized for that purpose.

Further yet, it should be understood that the foregoing relates only to a preferred embodiment of the present invention, and that numerous changes and modifications may be made therein without departing from the spirit and scope of the invention as defined in the following claims.

What is claimed is:

1. Aerobic exercise apparatus comprising:

a plurality of hollow tubular members interconnected to form a frame assembly;

a seat supported in predetermined relation to the frame assembly;

resiliently extensible means disposed within at least one tubular member of the frame assembly;

operating means connected to the extensible means and located outside the tubular members for engagement by an extremity of a person occupying the seat, whereby that person can exercise the extremity by engaging and manipulating the operating means in opposition to the resiliently extensible means;

the operating means comprising a forearm engagement member supported alongside the seat in predetermined position for engagement by an upright forearm of a person occupying the seat; and the resiliently extensible means urging the forearm engagement member to a rearward position relative to the seat, so that the person can engage the engagement member and move that member forwardly with a forearm in opposition to resilient force.

2. Apparatus as in claim 1, wherein:

the forearm engagement member comprises a generally C-shaped member mounted with the open mouth of the C facing rearwardly for engagement by the upright forearm of a seated person.

3. Apparatus as in claim 2, wherein:

the frame assembly includes a hollow tubular member extending behind a back portion of the seat;

the resiliently extensible means associated with the forearm engagement member comprises an elastic member received within the hollow tubular member.

4. Aerobic exercise apparatus comprising:

a plurality of hollow tubular members interconnected to form a frame assembly;

a seat supported in predetermined relation to the frame assembly;

resiliently extensible means disposed within at least one tubular member of the frame assembly;

operating means connected to the extensible means and located outside the tubular members for engagement by an extremity of a person occupying the seat, whereby that person can exercise the extremity by engaging and manipulating the operating means in opposition to the resiliently extensible means;

the operating means comprising a pair of elongated members located below the seat and constrained for movement along horizontal paths forward and backward relative to the seat;

the elongated members being laterally spaced apart from each other to lie substantially below the legs of a person occupying the seat;

the resiliently extensible means urging the elongated members rearwardly along their respective horizontal paths; and a foot engaging member associated with each elongated member, so that the person occupying the seat can engage a foot with a corresponding foot engaging member and selectively move each foot forwardly against the force exerted by the resiliently extensible means, and rearwardly.

5. Apparatus as in claim 4, wherein:

the frame assembly comprises a pair of hollow tubular members corresponding to each elongated member;

a second pair of tubular members telescopically received with the hollow tubular members;

each foot engaging member being connected to a corresponding second pair of tubular members; and the resiliently extensible means comprises an elastic member disposed within at least one hollow tubular member of each pair of such members and operative to urge rearwardly a corresponding second tubular member, so as to urge the foot engaging member rearwardly in relation to the frame assembly.

6. Apparatus as in claim 5, further comprising means operative to selectively adjust the amount of force exerted by the elastic member on the foot engaging member.

* * * * *